US006183384B1

(12) United States Patent
Roberto

(10) Patent No.: US 6,183,384 B1
(45) Date of Patent: Feb. 6, 2001

(54) HOCKEY STICK BLADE FOR ROLLER OR STREET HOCKEY

(76) Inventor: Cory Roberto, 1299 Canvey Crescent, Mississauga (CA), L5J 1S2

( * ) Notice: Under 35 U.S.C. 154(b), the term of this patent shall be extended for 0 days.

(21) Appl. No.: 09/378,717

(22) Filed: Aug. 23, 1999

(51) Int. Cl.[7] ..... A63B 59/14
(52) U.S. Cl. ..... 473/563
(58) Field of Search ..... 473/562–563

(56) References Cited

U.S. PATENT DOCUMENTS 3,377,065 * 4/1968 White, Sr. ..... 473/563
3,529,825 9/1970 White, Sr. .
5,511,776 4/1996 Huru .
5,685,792 * 11/1997 Ruoff ..... 473/563

FOREIGN PATENT DOCUMENTS

755982 * 4/1967 (CA) .

* cited by examiner

*Primary Examiner*—Mark S. Graham
(74) *Attorney, Agent, or Firm*—Marks & Clerk

(57) ABSTRACT

A hockey stick blade for roller or street hockey has a toe end, a heel end, top and bottom edges, a set of identical ball bearings, a set of identical sockets, at least one opening, and a shaft portion. Each socket is comprised of two identical truncated four-sided pyramids joined along their respective base edges. Each ball bearing is captured by one of each identical sockets and is mounted at the bottom of the hockey stick blade. The opening is positioned above each of the identical ball bearings, and allows for the unencumbered rotation of each of the ball bearings through 360 degrees in every direction. The shaft portion is adapted for fitment on the handle of a hockey stick. The opening in the hockey stick blade may be one of a series of slots positioned above each ball bearing or an elongated slot that extends from the first to the last ball bearings. The bottom edge of the hockey stick blade is split into two portions to allow the mounting of each of the bearing and socket pairs.

8 Claims, 2 Drawing Sheets

HOCKEY STICK BLADE FOR ROLLER OR STREET HOCKEY

FIELD OF THE INVENTION

This invention relates to the field of hockey sticks and the like. In particular, the invention relates to the blade portion associated with hockey sticks and its use in relation with hockey balls and hockey pucks. Thus, the present invention is particularly intended to be used in the practice for and play of roller hockey or street hockey, each of which is played with a ball or a puck.

BACKGROUND OF THE INVENTION

Hockey sticks, in their present form, have been employed for use in both street hockey and ice hockey for many years. With the emergence of in-line skates throughout the past decade, the popularity of roller hockey has been on the rise. Like in street hockey, roller hockey is most commonly played with a ball or a puck. However, hockey sticks when forced across a hard cement or paved surface when playing hockey create friction and often erode the blade. In addition, the blade often catches on discontinuities in the hard cement or paved surface. When playing ice hockey, the stick blade glides freely on the ice surface with little resistance. The desire to reduce drag specifically associated with the use of hockey sticks in both street and roller hockey is the focus of this invention. Limitations of the prior art encompass difficulties in terms of erosion of present day hockey stick blades and the friction associated with the use of these blades when playing both street hockey and roller hockey. It is a key feature of the present invention to facilitate a balance between outdoor in-line skates and sticks and ice hockey as it is known today. It is the intention of this invention to improve the movement of the hockey stick blade in dry land situations, most commonly street hockey and roller hockey.

A hockey stick blade for roller or street hockey in keeping with the present invention avoids the previously described limitations of the prior art. A hockey stick blade for roller or street hockey in keeping with the present invention comprises a toe end, a heel end, a top edge, a bottom edge, a set of identical ball bearings, a set of identical sockets, at least one opening, and a shaft portion. Each respective identical ball bearing is captured by one of each respective identical sockets and is built into the bottom edge of the hockey stick blade. The bottom edge of the hockey stick blade is split into two portions so as to accommodate the mounting of each respective identical ball bearing together with each respective identical socket on the bottom edge. The split along the bottom edge of the hockey stick blade is re-fastened typically by adhesive followed by heat and compression. Each of the ball bearings and their respective sockets are spaced along the length of the blade starting at the toe end working toward heel end. The opening formed through the thickness of the blade projects a distance above the uppermost surface of each of the identical ball bearings so as to allow the unencumbered rotation through 360 degrees in every direction, of each of the identical ball bearings. The opening is symmetric about its respective longitudinal axis extending from the toe end to the heel end of the hockey stick blade. The shaft portion is suitably connected through fasteners, bolts, screws or other suitable means to the heel end of the hockey stick blade and is adapted for fitment on the handle portion of a hockey stick. When such a blade is assembled to the handle portion of a hockey stick, the stick no longer need be carried while running or skating across a hard surface, instead it will pass freely over the cement or paved surface. Each of roller hockey and street hockey are particularly suited for the use of such a hockey stick blade so as to allow the free movement of the hockey stick across the cement or paved surface as well as increasing the opportunity for contact with the ball or puck in play.

DESCRIPTION OF THE PRIOR ART

U.S. Pat. No. 3,529,825 issued to WHITE Sr. teaches a hockey stick road adapter in which a number of balls are placed in a spaced relationship along the bottom edge of a hockey stick blade. Retainers hold the balls in an attached relationship with a blade-like attachment, and this blade-like attachment is mounted on one of the faces of the hockey stick blade. The blade-like attachment has a series of graduated sized chambers which enclose the balls. The blade-like assembly may be inserted into a notched-out portion of a hockey stick blade.

U.S. Pat. No. 5,511,776 issued to HURU teaches a roller hockey stick blade for use with a standard roller hockey ball. The blade as taught comprises a heel end, a toe end, a bottom edge, a top edge, and a elongated slot. The key to this blade is the elongated slot which is designed to cup the ball and achieve better control. The elongated slot is designed to lessen the possibility of the ball riding up on the blade making it difficult for the stick user to make an accurate shot.

SUMMARY OF THE INVENTION

In accordance with one aspect of the present invention, there is provided a hockey stick blade for use in roller or street hockey. The hockey stick blade comprises a toe end, a heel end, a top edge, and a bottom edge which define the general shape of the blade. There is a shaft portion which is suitably connected to the heel end of the hockey stick blade and is adapted to receive the handle portion of the hockey stick. There is also a set of identical ball bearings, a set of identical sockets, and at least one opening.

Each of the identical sockets formed from two identical truncated four-sided pyramids are joined together along their respective base edges and each truncated surface is parallel to the base edge. The base of the first truncated four-sided pyramid is joined to the base of the second four-sided pyramid to form a single socket. The midpoint of each identical socket is along the adjoined base edges and a centreline extends through the midpoints of each of the identical sockets. This centreline is parallel to the longitudinal axis of the opening.

Each of the identical ball bearings is spherical and has a smooth surface. Each identical ball bearing is captured by a respective one of the identical sockets. The midpoint of each identical socket is located at the midpoint of each identical ball bearing and together each socket and ball bearing pair are mounted on the bottom edge of the hockey stick blade. Each ball bearing and socket combination mounted on the bottom edge of the hockey stick blade is able to freely rotate through 360 degrees in any direction.

The opening formed in the hockey stick blade extends through the thickness of the hockey stick blade projects at least a distance above the uppermost surface of each identical ball bearing so as to allow the unencumbered rotation of each of the identical ball bearings. The opening is symmetric about its respective longitudinal axis extending from the toe end to the heel end of the hockey stick blade. The opening in the hockey stick blade may be a series of openings. The number of openings is equivalent to the number of identical ball bearings. In a second instance, the opening is an elongated slot that extends from the first of the identical ball bearings to the last of the identical ball bearings.

The bottom edge of the hockey stick blade is split into two portions. The split is designed to accommodate the mounting of the respective identical ball bearing and identical socket pairs on the base edge of the hockey stick blade. The two portions of the bottom edge of the hockey stick blade are re-fastened by suitable means, typically an adhesive followed by heat and compression.

The hockey stick blade has at least two identical ball bearing and identical socket pairs mounted on the bottom edge of the hockey stick blade. Where more than two ball bearing and sockets pairs are desired, spacing of these ball bearing sockets pairs is along the bottom edge of the hockey stick blade.

The width of the bottom edge of the hockey stick blade is at least equivalent to the diameter of each of the identical ball bearings plus a distance of at least one eighth of and inch.

In a particular embodiment of the present invention, a set of five identical ball bearings, each typically one-quarter inch in diameter, are mounted along the length of the bottom edge of the hockey stick blade. The blade itself may be 12 inches in length from heel end to toe end, and the bottom edge may have a width of one half inch. In such a configuration, the identical ball bearing are placed as follows: the first 1 inch from the toe end of the hockey stick blade, the second, third, fourth, and fifth at 4 inches, 7 inches, 10 inches, and 12 inches from the toe end of the hockey stick blade respectively.

The identical ball bearings are constructed from plastic, rubber, metal, or combinations thereof and form a rigid spheroid for mounting on the bottom edge of the hockey stick blade.

The hockey stick blade is constructed from plastic, aluminum, wood, or combinations thereof.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
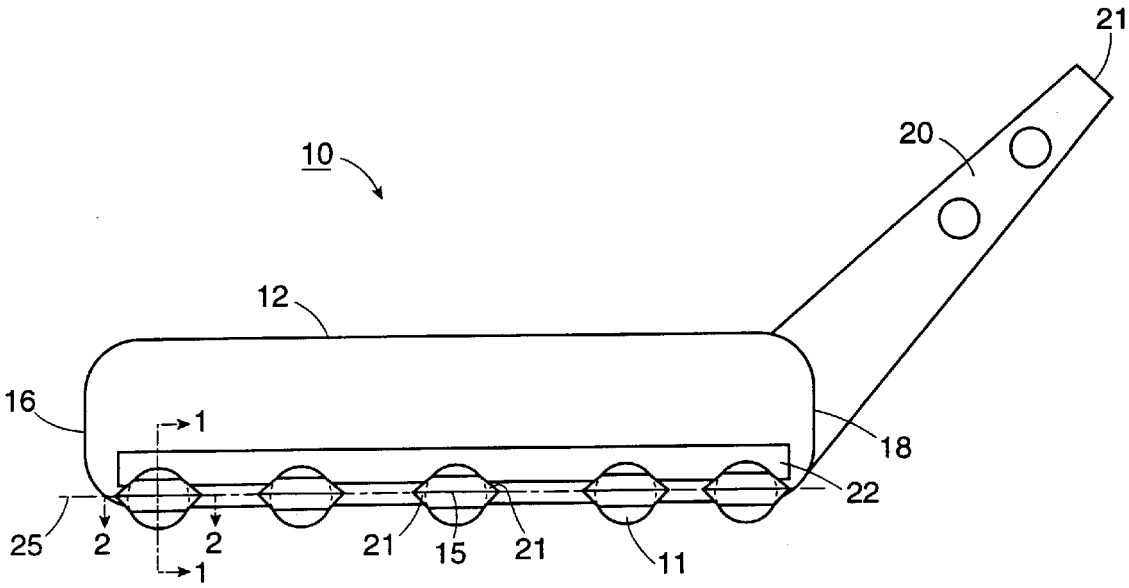
FIG. 1 is a perspective view of a first preferred embodiment of the hockey stick blade for roller or street hockey, in keeping with the present invention.

Referring now to the drawings, there is illustrated hockey stick blade for roller or street hockey, generally designated by reference numeral 10. The hockey stick blade in FIG. 1 is shown in a detailed view. The hockey stick blade 10 comprises a top edge 12, a bottom edge 14, a toe end 16, and heel end 18, at lease one opening 22, a set of identical ball bearings 11, a set of identical sockets 24, and a shaft portion 20.

The heel end 18 of the hockey stick blade 10 is connected by suitable means to the shaft portion 20. The end 21 of the shaft portion 20 is adapted for fitment of the handle portion of a hockey stick.

Each of the identical sockets 24 formed from two identical truncated four-sided pyramids 21 are joined along their respective base edges to form a single socket 24. Each truncated surface of each identical four-sided truncated pyramid 21 is parallel with the base edge. The midpoint 15 of each of the sockets 24 is along the adjoined base edges and a centreline 25 extends through the midpoints 15 of each of the identical sockets 24.

Each of the identical ball bearings 11 is captured by one of each of the identical sockets 24. The midpoint of each ball bearing 17 at the midpoint of each identical socket 15 and both midpoints 15, 17 are located along the centreline 25. Together, each identical ball bearing 11 and each identical socket 24, is mounted in the bottom edge 14 of the hockey stick blade 10. When each identical ball bearing 11 and each identical socket 24 pairs are mounted on the bottom edge 14 of the hockey stick blade 10, each identical ball bearing 11 is able to freely rotate through 360 degrees in any direction.

The opening 22 formed through the thickness of the hockey stick blade 10 is positioned above each identical ball bearing 11 when each of the ball bearing 11 and socket 24 pairs are mounted on the bottom edge 14 of the hockey stick blade 10. The opening 22 allows for the unencumbered rotation of each identical ball bearing 11. The opening 22 is symmetric about its respective longitudinal axis 13 extending from the toe end 16 to the heel end 18 of the hockey stick blade 10.

Figure 2:
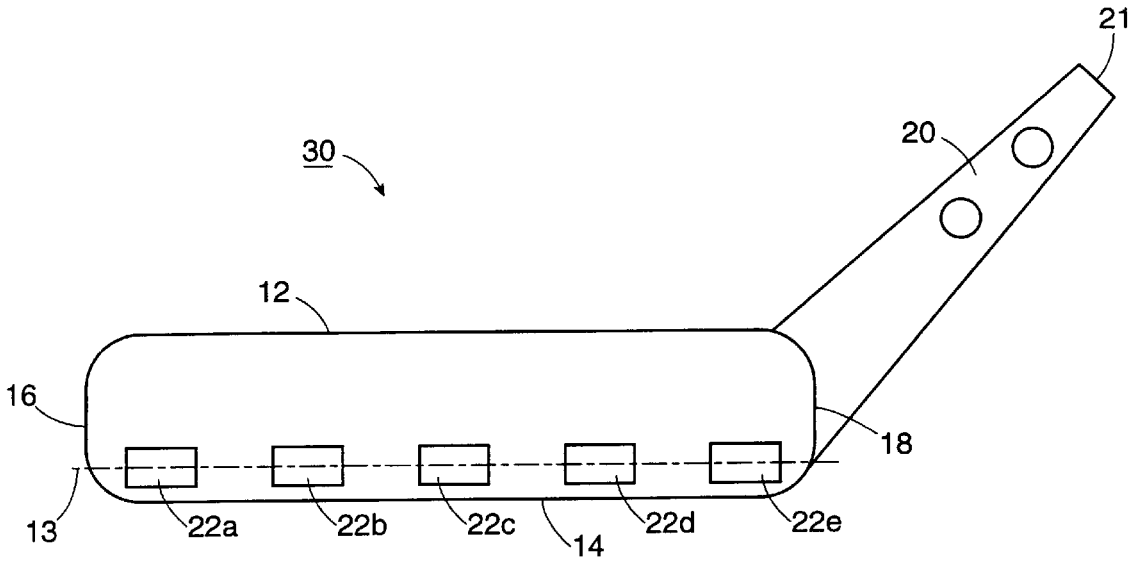
FIG. 2 is an alternative embodiment of the hockey stick blade for roller or street hockey.

FIG. 2 shows an alternative embodiment of the hockey stick blade 30. In this instance, the opening 22 is comprised of a series of openings 22*a* through 22*e* where the number of openings 22 is equivalent to the number of identical ball bearings 11 to be mounted on the bottom edge 14 of the hockey stick blade.

Figure 3:
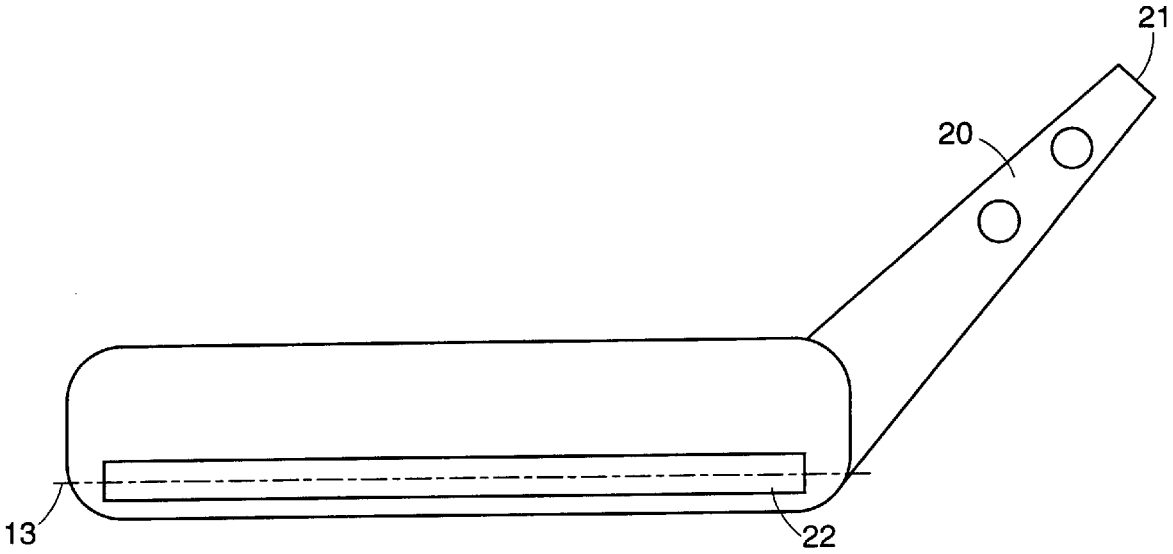
FIG. 3 is a side view of the first embodiment of the hockey stick blade.

Referring now to FIG. 3, a side view of the hockey stick blade 10. The opening 22 is shown as an elongated opening 22 spanning the length through which the identical ball bearings 11 are to be mounted.

Figure 4:
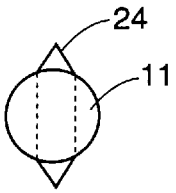
FIG. 4 is a cross-sectional view taken along the line 1—1 of the embodiment of FIG. 1.

FIG. 4 shows a cross-section view taken along the line 1—1. The side view of one identical ball bearing 11 captured by a socket 24 illustrates the configuration of the two identical truncated four-sided pyramids 21 to form a single socket 24.

Figure 5:
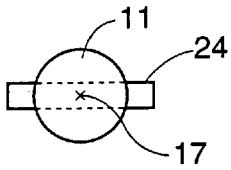
FIG. 5 is a cross-sectional view taken along the line 2—2 of the embodiment of FIG. 1.

FIG. 5 shows a cross-sectional view taken alone the line 2—2.

Figure 6:
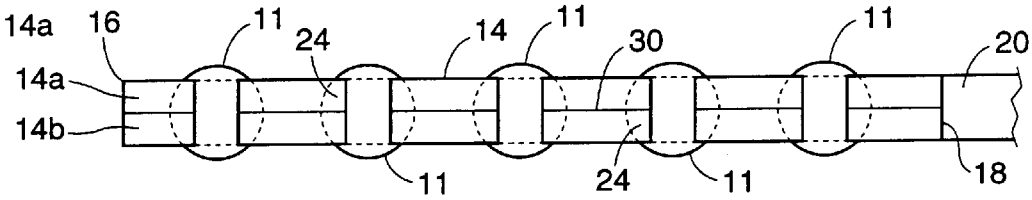
FIG. 6 is view of the bottom of the hockey stick blade.

The bottom edge 14 of the hockey stick blade 10 is split into two portions 14*a* and 14*b*, as seen in FIG. 6. The split is designed to accommodate the mounting of the identical ball bearings 11 together with the respective identical sockets 24 on the bottom edge 14 of the hockey stick blade 10. The split 30 along the bottom edge of the hockey stick blade 10 is refastened by suitable means, typically an adhesive followed by heat and compression.

The identical ball bearings 11 are constructed formed from plastic, rubber, metal, or combinations thereof. The hockey stick blade 10 has at least two identical ball bearings and respective socket pairs mounted on the bottom edge 14 of the hockey stick blade 10. Where more than two identical ball bearing 11 and socket 24 pairs are desired, the spacing of these ball bearing 11 and socket 24 pairs is along the bottom edge 14 of the hockey stick blade. The width of the bottom edge 14 of the hockey stick blade 10 is at least equivalent to the diameter of each of the identical ball bearings 11 plus a distance of at least one eighth of an inch.

In a particular embodiment of the present invention, a set of five identical ball bearings 11, each typically one-quarter inch in diameter, are mounted along the length of the bottom edge 14 of the hockey stick blade 10. The blade itself may be 12 inches in length from heel end 18 to toe end 16, and the bottom edge 14 may have a width of one half inch. In such a configuration, the identical ball bearing 11 are placed as follows: the first 1 inch from the toe end 16 of the hockey stick blade 10, the second, third, fourth, and fifth at 4 inches, 7 inches, 10 inches, and 12 inches from the toe end 16 of the hockey stick blade 10 respectively.

The general purpose for this apparatus in keeping with the present invention is to reduce friction experienced on the blade portion of a hockey stick when playing roller or street hockey. The apparatus as discussed is adapted for fitment on the handle portion of a hockey stick and is constructed from plastic, wood, aluminum, or combinations thereof.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

Moreover, use of the terms "he", "him", or "his", is not intended to be specifically directed to persons of the masculine gender, and could easily be read as "she", "her", or "hers", respectively.

What is claimed is:

1. A hockey stick blade for roller or street hockey attachable to the handle portion of a hockey stick;

said hockey stick blade comprising:

a toe end;

a heel end;

a top edge;

a bottom edge;

a set of identical ball bearings, wherein each of said identical ball bearings is spherical and has a smooth surface;

a set of identical sockets;

at least one opening; and a shaft portion;

wherein each of said identical sockets is comprised of two identical truncated four-sided pyramids, wherein the truncated end of each pyramid is remote from the base of each pyramid and the base of each truncated pyramid is parallel to the edge of the truncated end of each pyramid; wherein the base of the first pyramid is joined with the base of the second pyramid to form one of said sockets, wherein a midpoint of each identical socket is located at the point where the base of the first pyramid and the base of the second pyramid is joined; and wherein a centreline extends through each midpoint of each of said identical sockets;

wherein each of said identical ball bearings is captured by one of each of said identical sockets; wherein the midpoint of each of the identical sockets is located at a midpoint of each of said identical ball bearings;

wherein each of said identical ball bearings and each of said respective identical sockets together are mounted on said bottom edge of said hockey stick blade; wherein each of said identical ball bearings when mounted on said bottom edge of said hockey stick blade is able to freely rotate a full 360 degrees in every direction; and wherein said opening is positioned above each of said identical ball bearings when mounted on said bottom edge of said hockey stick blade such that said opening allows for the unencumbered rotation of each of said identical ball bearings;

wherein said opening formed in said hockey stick blade projects at least a distance above the uppermost surface of each of said identical ball bearings so as to allow the unencumbered rotation of each of said identical ball bearings; and wherein said opening is symmetric about its respective longitudinal axis extending from said toe end of said hockey stick blade to said heel end of said hockey stick blade; and wherein said shaft portion is suitably connected to said heel end of said hockey stick blade; and wherein said shaft portion is adapted for fitment on the handle portion of a hockey stick.

2. The hockey stick blade of claim 1, wherein said opening is a series of slots wherein said opening spans the diameter of each identical ball bearing; and wherein the number of openings is equivalent to the number of said identical ball bearings.

3. The hockey stick blade of claim 1, wherein said opening is an elongated slot through the thickness of said hockey stick blade; wherein said elongated opening extends from a first of said identical ball bearings to a last of said identical ball bearings; and wherein the elongated opening has a longitudinal axis extending from said toe end to said heel end of said hockey stick blade and said longitudinal axis is equivalent to said centre line passing through said midpoint of each of said identical ball bearing and said socket pairs.

4. The hockey stick blade of claim 1, wherein said bottom edge of said hockey stick blade is split into two portions; wherein said split is designed to accommodate the mounting of said identical ball bearings together with said identical sockets on said bottom edge of said hockey stick blade; wherein the two portions of said bottom edge are refastened by suitable means.

5. The hockey stick blade of claim 1, wherein each of said identical ball bearings is constructed of a material chosen from the group of plastic, rubber, metal, or combinations thereof.

6. The hockey stick blade of claim 6, wherein at least two of said identical ball bearings and two of said respective identical sockets are built in to said bottom edge of said hockey stick blade.

7. The hockey stick blade of claim 1, wherein the width of said bottom edge of said hockey stick blade is at least equivalent to the diameter of each of said identical ball bearings plus a distance of at least one eighth of an inch.

8. The hockey stick blade of claim 1, wherein said hockey stick blade is constructed from a material chosen from the group of plastic, aluminum, wood.

* * * * *